US010260445B2

(12) United States Patent
Nieddu

(10) Patent No.: US 10,260,445 B2
(45) Date of Patent: Apr. 16, 2019

(54) METHOD OF CONTROLLING A FUEL INJECTION SYSTEM DURING RAIL PRESSURE SENSOR FAILURE CONDITION

(71) Applicant: GM GLOBAL TECHNOLOGY OPERATIONS LLC, Detroit, MI (US)

(72) Inventor: Stefano Nieddu, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 307 days.

(21) Appl. No.: 15/170,434

(22) Filed: Jun. 1, 2016

(65) Prior Publication Data

US 2016/0356238 A1 Dec. 8, 2016

(30) Foreign Application Priority Data

Jun. 3, 2015 (GB) ..... 1509639.9

(51) Int. Cl.
*F02D 41/38* (2006.01)
*F02D 41/22* (2006.01)
*F02D 41/14* (2006.01)

(52) U.S. Cl.
CPC ..... *F02D 41/3845* (2013.01); *F02D 41/1401* (2013.01); *F02D 41/222* (2013.01); *F02D 2041/1424* (2013.01); *F02D 2041/1432* (2013.01); *F02D 2041/223* (2013.01);
(Continued)

(58) Field of Classification Search
CPC ..... F02D 2041/223; F02D 2200/0604; F02D 2200/0616; F02D 41/1401; F02D 41/222; F02D 41/3845; F02D 2041/1424; F02D 2041/1432
See application file for complete search history.

(56) References Cited

U.S. PATENT DOCUMENTS 6,105,554 A * 8/2000 Nishiyama ..... F02D 41/12 123/357
6,220,218 B1 * 4/2001 Saiki ..... F02D 31/008 123/325
2007/0125343 A1 6/2007 Hayakawa
(Continued)

FOREIGN PATENT DOCUMENTS

GB 2513296 A 10/2014
JP 2011111905 A 6/2011
WO 2013156161 A1 10/2013

OTHER PUBLICATIONS

Great Britain Patent Office, Great Britain Search Report for Great Britain Application No. 1509639.9, dated Nov. 5, 2015.

*Primary Examiner* — Sizo B Vilakazi
(74) *Attorney, Agent, or Firm* — Lorenz & Kopf, LLP

(57) ABSTRACT

A method of controlling the fuel rail pressure of a fuel injection system of an internal combustion engine is disclosed. A failure condition of a fuel rail pressure sensor is detected. A fuel rail pressure target value and an injector fuel output target value are determined on the basis of an internal combustion engine operating condition. A fuel pump output target value to be supplied into the fuel rail is determined. The fuel pump is driven in order to provide the fuel pump output target value. The fuel pump output target value is determined on the basis of the injector fuel output target value, and the fuel injector is energized for an energizing time target value determined on the basis of the fuel rail pressure target value and the injector fuel output target value.

13 Claims, 10 Drawing Sheets

(52) U.S. Cl.
CPC ..... *F02D 2200/0604* (2013.01); *F02D 2200/0616* (2013.01)

(56) References Cited

U.S. PATENT DOCUMENTS

| | | | | |
|---|---|---|---|---|
| 2009/0326788 | A1* | 12/2009 | Yuasa | F02D 41/3809 701/104 |
| 2010/0319444 | A1* | 12/2010 | Miyaura | F02D 35/026 73/114.49 |
| 2012/0245824 | A1* | 9/2012 | Miura | F02D 41/22 701/104 |
| 2012/0255521 | A1 | 10/2012 | Aoki et al. | |
| 2015/0112576 | A1 | 4/2015 | Watanabe | |

* cited by examiner $$\begin{bmatrix} a_{11} & a_{12} \\ a_{21} & a_{22} \end{bmatrix}$$

METHOD OF CONTROLLING A FUEL INJECTION SYSTEM DURING RAIL PRESSURE SENSOR FAILURE CONDITION

CROSS-REFERENCE TO RELATED APPLICATION

This application claims priority to Great Britain Patent Application No. 1509639.9, filed Jun. 3, 2015, which is incorporated herein by reference in its entirety.

TECHNICAL FIELD

The present disclosure relates to a method of controlling and adjusting the fuel pressure in a fuel rail of an internal combustion engine, which can be widely applied in automotive field and, more particularly, for a method for fuel pressure control of a Fuel Injection System (FIS) in an internal combustion engines actuated by an Electronic Control Unit (ECU) of an automotive system.

BACKGROUND

It is known that modern internal combustion engines are provided with a fuel injection system (FIS) for directly injecting the fuel into the cylinders of the engine. As an example, a common rail system (CRS) is a common configuration for Diesel Engines. The CRS, generally, includes a fuel pump, hydraulically connected to a fuel common rail and one or more electrically controlled fuel injectors, which are individually located in a respective cylinder of the engine and which are fluidically connected to the fuel rail through dedicated injection pipes.

The fuel pump is controlled in order to provide a fuel pump output, i.e. to supply fuel to the rail, and the at least one injector is controlled to provide an injector fuel output, i.e. to supply fuel, exiting from the rail, to the cylinder of the engine.

It has to be noted that the term "fuel output" is used herein to indicate a fuel quantity or a fuel quantity provided in an interval, thus representing a fuel flow rate. It has to be also noted that the fuel quantity provided in an interval can be referred to as a time interval, or to at least part of a cycle (or of an event), for example of the fuel pump or of the engine during its operation. As known, the fuel quantity provided can be indicated for example as a function of a stroke, or a combustion cycle, etc., thus indicating also in this case a fuel flow rate, i.e. as a fuel quantity provided in an interval.

Returning now to the fuel injection system, the rail pressure may be an important parameter for determining the quality of the fuel injection within an engine (for example, the fuel spray penetration in the cylinder head). The rail pressure must be regulated as function of the engine operating conditions. For example a target value of the fuel rail pressure can be determined according to an engine load vs. engine speed map. Thus, the fuel rail pressure is controlled in order to reach the target value of the fuel rail pressure needed in the relevant fuel injection system conditions.

The fuel rail pressure can be controlled by adjusting the fuel flow-rate (fuel quantity) pumped into the fuel rail by the fuel pump output. This adjustment of the fuel flow-rate (fuel quantity) can be determined with a sensor based feedback control. In particular, a pressure sensor detects the pressure within the fuel rail, and the detected value is compared with the fuel rail pressure target value. Subsequently, the fuel flow rate (fuel quantity) pumped into the fuel rail is adjusted in order to minimize the error between the target value of fuel rail pressure and the value of fuel rail pressure measured by the fuel rail pressure sensor.

The fuel output of the fuel pump can be adjusted in different ways. As an example, it is possible to control the electric signal driving a fuel-metering valve, usually associated to the high-pressure fuel pump, to regulate the fuel flow-rate (fuel quantity) which is supplied into the fuel rail. The fuel-metering valve may be integrated in the high-pressure fuel pump, in order to realize a single device that is usually referred as fuel metering unit. The fuel-metering valve may be a suction control valve (SCV) or a digital valve. The electric signal driving the metering valve (i.e. the signal that causes the high-pressure fuel pump to provide the required fuel pump output, or in other words to supply the required fuel flow-rate (fuel quantity)) may be an electrical current for SCVs or the timing of the electric pulses for digital valves.

As mentioned above, the fuel output of the fuel pump is determined as a function of the difference between the fuel rail pressure target value and the value of the pressure measured by the fuel rail pressure sensor. In case of failure of the rail pressure sensor, it is not possible to carry out the above mentioned feedback control. As a result, the fuel rail pressure cannot be regulated, so that the engine must be shut-down to avoid problems.

SUMMARY

In view of the above, the present disclosure provides a method of controlling the fuel rail pressure of a fuel injection system of an internal combustion engines during a fuel rail pressure sensor failure condition. The present disclosure also provides a method of controlling the fuel rail pressure of a fuel injection system of an internal combustion engine, which allows to keep the fuel injection system in a correct operating condition, even if the fuel rail pressure sensor is in a failure condition, for example for a period of time sufficient to drive to a mechanic's workshop. The present disclosure may implement the above-mentioned methods with a simple and inexpensive solution in an Engine Control Unit of an automotive system.

An embodiment of the present disclosure provides for a method of controlling the fuel rail pressure of a fuel injection system of an internal combustion engine including a fuel rail, at least one fuel pump, at least one fuel rail pressure sensor and at least one injector. The method includes (a) detecting a failure condition of the fuel rail pressure sensor; (b) determining a fuel rail pressure target value and an injector fuel output target value on the basis of an internal combustion engine operating condition; (c) determining a fuel pump output target value to be supplied into the fuel rail; (d) driving the at least one fuel pump in order to provide the fuel pump output target value determined in (c). The fuel pump output target value is determined in (c) on the basis of the injector fuel output target value determined in (b), and the fuel injector is energized for an energizing time target value determined on the basis of the fuel rail pressure target value and the injector fuel output target value.

Advantageously, when a failure condition of the fuel rail pressure sensor is detected, the fuel rail pressure control can be carried out without a fuel rail pressure measurement. As already mentioned above, the term "fuel output" is used herein to indicate a fuel quantity or a fuel quantity provided in an interval (e.g. a flow rate). More in detail, the injector fuel output target value determined in an internal combustion engine operating condition indicates the fuel quantity or the fuel flow rate which has to be supplied into the engine cylinder by the injector (i.e. the fuel quantity or the fuel flow rate exiting the fuel rail due to the operation of the at least one injector and its leakages). The fuel pump output target value indicates the fuel quantity or the fuel flow rate which has to be supplied into the rail by the fuel pump.

According to an aspect of the present disclosure, the fuel pump output target value determined in (c) is equal to the injector fuel output target value determined in (b). This aspect of the present disclosure allows, in a simple manner, to keep the fuel injection system in a correct operating condition when there is no feedback of the fuel rail pressure sensor. As a result, the fuel injection system can operate in a safe manner even when a fuel rail pressure sensor failure condition is detected, e.g. when the fuel rail pressure sensor stops working.

According to another aspect of the present disclosure, the fuel pump output target value determined in (c) is equal to the sum of the injector fuel output target value and a compensation value. The compensation value is determined as a function of the fuel rail pressure target value. As a result, the response of the above disclosed control is more similar to the one achievable with a fuel feedback control based on a rail pressure sensor.

It has to be noted that also the compensation value can be expressed as a fuel quantity or a fuel quantity provided in an interval (e.g. a flow rate). According to a particular aspect of the present disclosure, the compensation value is determined by means of a transfer function in the Laplace domain in the form of:

$$\Delta Q^*_{rail} = \frac{sC^*_{hyd}}{sC^*_{hyd}/K_p + 1} P^*$$

wherein $C^*_{hyd}$ is an equivalent hydraulic capacitance of the fuel volume stored inside the fuel rail and the pipes connected to it, and $K_p$ is a proportional gain. As a result, it is possible to carry out a sensor-less fuel rail pressure control in an particularly effective manner, also when the operating conditions of the fuel injection system varies rapidly, e.g. during operation in urban traffic.

According to another aspect of the present disclosure, the compensation value is rescaled multiplying the compensation value to a rescaling factor. As a result, it is possible to adjust the dynamic behavior of the fuel rail pressure sensor-less control.

According to an aspect of the present disclosure, the rescaling factor is equal to:

$$\left(1 - \frac{C^*_{hyd}}{K_p} \cdot \frac{1}{\tau}\right)$$

wherein $\tau$ is a delay according to which the fuel rail pressure reaches the fuel rail pressure target value when the fuel pump output target value is made equal to the injector fuel output target value. An advantage of this aspect is that the sensor-less fuel rail pressure control has the same dynamic behavior of a fuel rail pressure feedback control based on the fuel rail pressure sensor.

According to an aspect of the present disclosure, $\tau$ depends on the injector characteristic and the fuel rail hydraulic capacitance, according to the relationship:

$$\tau = \frac{\partial P}{\partial Q_{inj}} \cdot C_{hyd}$$

This aspect allows to calculate a particularly effective rescaling factor.

According to an aspect of the present disclosure, the energizing time target value is a function of the fuel rail pressure target value and of the injector fuel output target value according to a fuel injector characteristic. An advantage of this aspect is that an effective value of the energizing time target value may be chosen.

According to an aspect of the present disclosure, driving the fuel pump in (d) is carried out by a driving signal determined from a nominal driving signal ($r_n$), which is function of the fuel rail pressure target value, and a function based correction term determined by a compensation function. As a result aspect, it is possible to provide for a compensation of the error of the pump in (d), as the pump may supply a fuel pump output (fuel quantity or fuel flow rate) different from the expected fuel pump output (fuel quantity or fuel flow rate) target value.

According to an aspect of the present disclosure, the compensation function depends on a plurality of operating parameters of the fuel injection system of an internal combustion engine. As a result, the output of the compensation function is particularly accurate.

According to an aspect of the present disclosure, the compensation function is determined before (a). As a result, it is possible to use the data collected by the rail pressure sensor in order to determine the compensation function.

According to an aspect of the present disclosure, the method includes (s1) determining a compensation error as a function of the fuel rail pressure value measured by the fuel pressure sensor; (s2) determining a plurality of coefficients as a function of the plurality of operating parameters; (s3) determining a correction term from the compensation error by means of an integrative regulator; (s4) repeating (s1)-(s3) a plurality of times in order to obtain different values of the correction term as a function of different values of the operating parameters; and (s5) determining the compensation function (560) as a function of the different values of the correction term ($\Delta r$). The integrative regulator includes the operation of summing the products between an integrator with each of the coefficients and wherein (s1)-(s5) are carried out before (a) of detecting a failure condition of the fuel rail pressure sensor. As a result, it is possible to determine a precise compensation function, taking into account different operating parameters of the fuel injection system.

According to an aspect of the present disclosure, the method includes memorizing the compensation function during (s5). As a result, the compensation function, once memorized, may be used in the future according to the needs.

According to an aspect of the present disclosure, the plurality of operating parameters include the fuel pump output (fuel quantity or fuel flow rate) target value and the rotational speed of the fuel pump. According to another aspect of the present disclosure, the plurality of operating parameters further includes the fuel rail pressure target value. These parameters have been proven to be particularly effective in order to determine a precise compensation function.

The method of the present disclosure can be carried out with the help of a computer program including a program-code for carrying out all the steps of the method described above, and in the form of a computer program product including the computer program. The method can be also embodied as electromagnetic signals, the signal being modulated to carry a sequence of data bits which represent a computer program to carry out all steps of the method.

Another embodiment of the present disclosure provides for a control apparatus for an internal combustion engine, including an Electronic Control Unit (ECU), a memory system associated to the Electronic Control Unit (ECU) and a computer program including a program-code for carrying out all the steps of the method described above, the computer program being stored in the memory system.

Another embodiment of the present disclosure provides for a control apparatus for controlling the fuel rail pressure of a fuel injection system of an internal combustion engine including a fuel rail, at least one fuel pump, at least one fuel rail pressure sensor and at least one injector, wherein the control apparatus includes: a sensor, circuit or other means for detecting a failure condition of the fuel rail pressure sensor; a processor, control unit or other means for determining a fuel rail pressure target value and an injector fuel output target value on the basis of an internal combustion engine operating condition; a processor, control unit or other means for determining a fuel pump output target value to be supplied into the fuel rail; and a processor, control unit or other means for driving the at least one fuel pump in order to provide the fuel pump output target value determined. The control apparatus may further include a processor, circuit or other means for determining fuel pump output target value on the basis of the injector fuel output target value. The control apparatus further includes a processor, circuit or other means to energize the at least one fuel injector for an energizing time target value determined on the basis of the fuel rail pressure target value and the injector fuel output target value.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
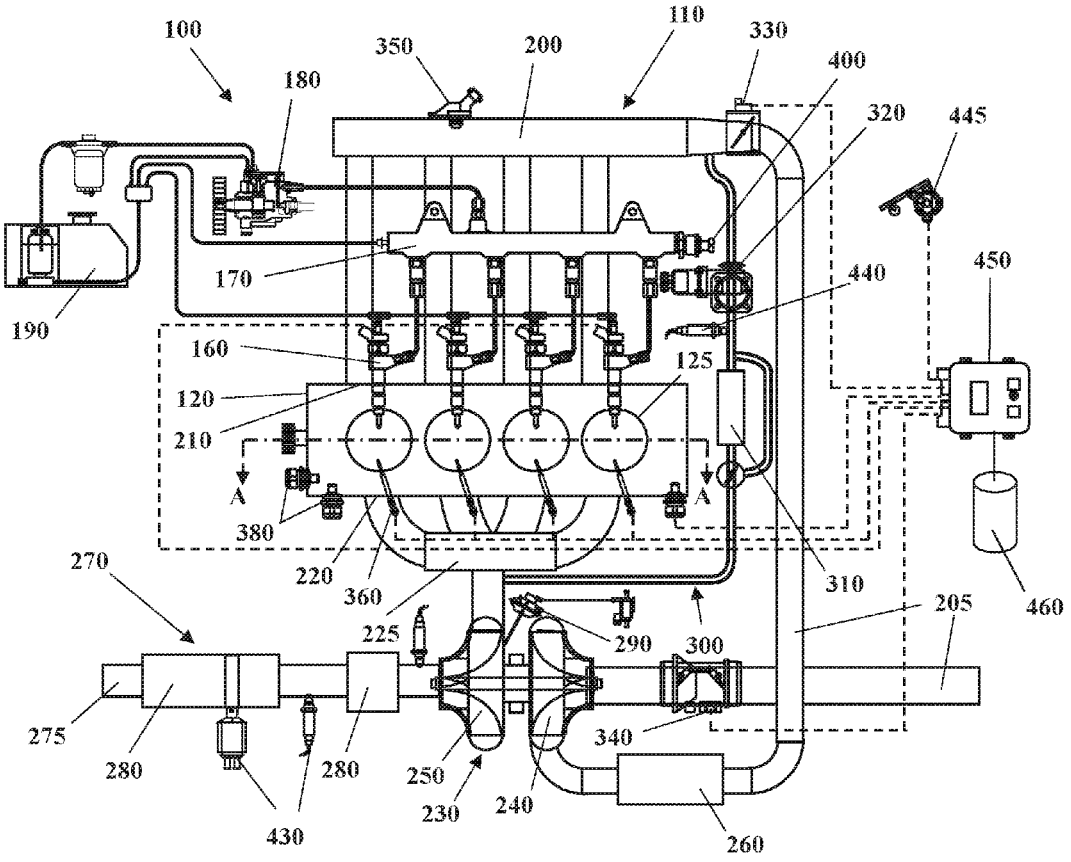
FIG. 1 schematically shows an automotive system belonging to a motor vehicle.
Figure 2:
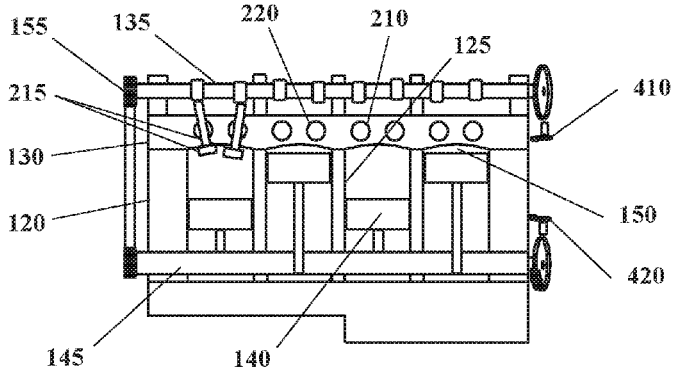
FIG. 2 is the section A-A of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150.

A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

In the combustion chamber 150 is located a glow plug 360 which is a heating element which is electrically activated for cold starting of the engine and also for improving the combustion performance within the combustion chamber.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust gases exit the turbine 250 and are directed into an exhaust system 270. The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor that may be integral within the glow plugs 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR valve 320, the VGT actuator 290, and cam phaser 155 and the glow plug 360. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system 460, and send and receive signals to/from the interface bus. The memory system 460 may include various storage types including optical storage, magnetic storage, solid state storage, and other non-volatile memory. The interface bus may be configured to send, receive, and modulate analog and/or digital signals to/from the various sensors and control devices.

The program may embody the methods disclosed herein, allowing the CPU to carryout out the steps of such methods and control the ICE 110. The program stored in the memory system 460 is transmitted from outside via a cable or in a wireless fashion. Outside the automotive system 100 it is normally visible as a computer program product, which is also called computer readable medium or machine readable medium in the art, and which should be understood to be a computer program code residing on a carrier, the carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing the computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

With reference to FIGS. 3-12, an embodiment of a method of controlling the fuel rail pressure within a fuel injection system 500 of the internal combustion engine 110 will be now discussed. In the shown embodiments, the fuel injection system 500 includes the fuel rail 170, the fuel pump 180, the fuel rail pressure sensor 400 and at least one injector 160.

Figure 3:
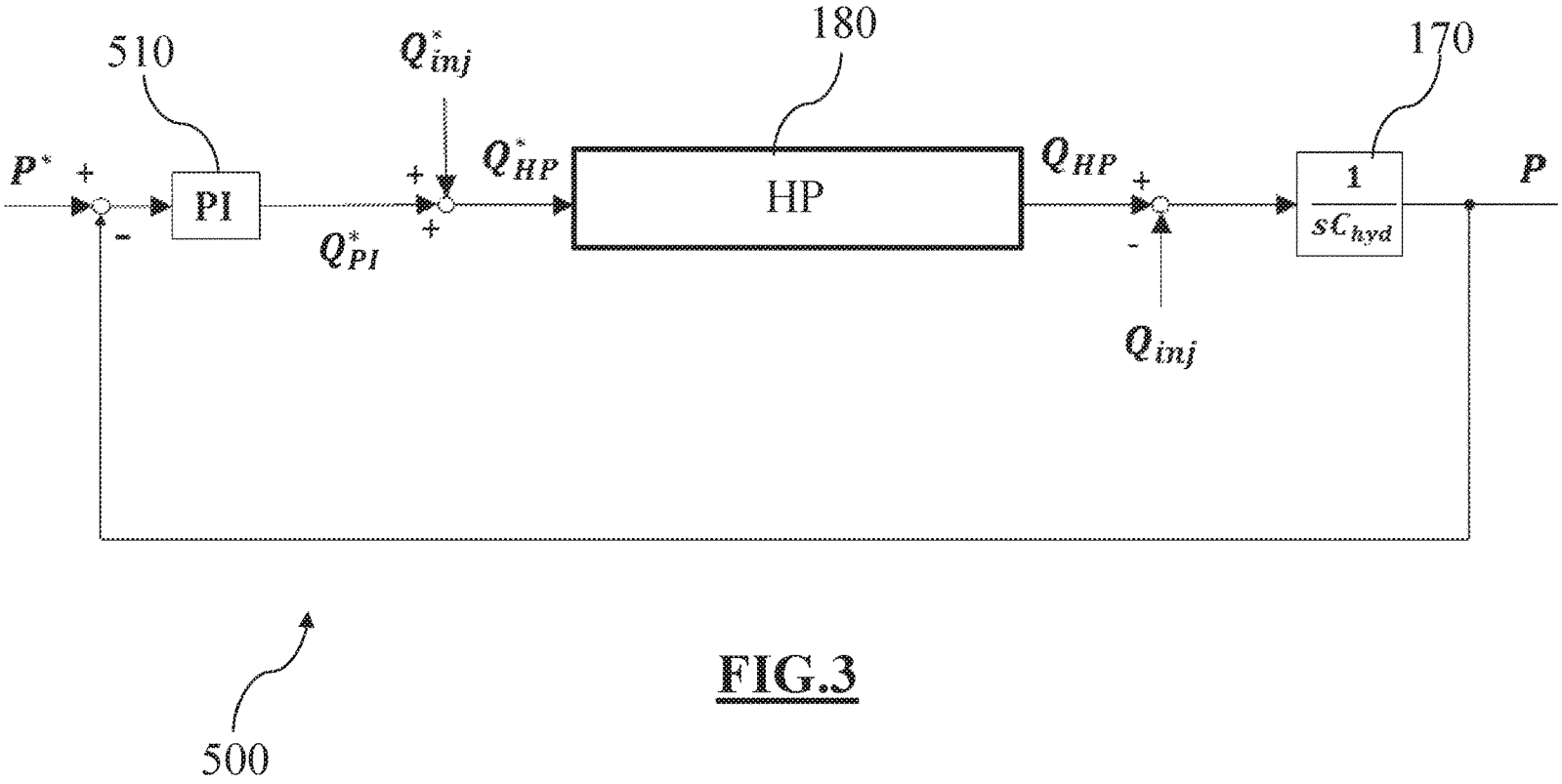
FIG. 3 is a block diagram of a Fuel Injection System with a based sensor feedback control of the fuel rail pressure.

More in detail, FIG. 3 shows a block diagram of the fuel injection system 500 with a sensor based feedback control of the fuel rail pressure in a normal pressure sensor condition (i.e. when the pressure sensor 400 is not in a failure condition). In particular, the fuel pump 180 supplies a fuel pump output (fuel quantity or fuel flow rate) $Q_{HP}$ into the fuel rail 170. Contemporaneously, an injector fuel output (fuel quantity or fuel flow rate) $Q_{inj}$ exits the fuel rail due to the operation of the fuel injector 160 and its leakages. In other words, the injector fuel output $Q_{inj}$ is indicative of the fuel quantity (fuel flow rate) exiting the fuel rail due to the operation of the fuel injector 160 and the relative leakages. The difference between the fuel pump output (quantity or flow rate) $Q_{HP}$ entering the fuel rail 170 and the injector fuel output (quantity or flow rate) $Q_{inj}$ exiting the fuel rail 170 determines the value of the fuel rail pressure P.

In particular, when the fuel pump output $Q_{HP}$ exceeds the injector fuel output $Q_{inj}$ the fuel rail pressure P is raised. Similarly, when the two values are identical, the fuel rail pressure P is kept constant. On the contrary, when the fuel pump output $Q_{HP}$ is lower than the injector fuel output $Q_{inj}$ the fuel rail pressure P is lowered. The relation between the difference $Q_{HP}$-$Q_{inj}$ and the value of fuel rail pressure P can be represented by a transfer function in the form of an integrator in Laplace domain:

$$\frac{1}{sC_{hyd}}$$

wherein $C_{hyd}$ is a value representing the hydraulic capacitance of the fuel volume stored inside the fuel rail 170 and the pipes connected to it.

In order to control the operation of the above described system 500, a fuel rail pressure target value P* (i.e. to be achieved inside the fuel rail 170) is firstly determined. In an embodiment, the fuel rail pressure target value P* may be determined by the ECU 450 on the basis of the engine operating conditions, according to a conventional strategy. Subsequently, the real value P of the fuel rail pressure is measured by the fuel rail pressure sensor 400, and the difference between the fuel rail pressure target value P* and the detected fuel rail pressure value P is evaluated, e.g. by the ECU. Subsequently, the ECU determines the adjustment of the fuel pump output $Q_{HP}$, i.e. the fuel flow rate (fuel quantity) that should be supplied into the fuel rail 170 in order to reach the fuel rail pressure target value P*, i.e. in order to minimize the above mentioned difference between the fuel rail pressure target value P* and the detected fuel rail pressure value P.

In more detail, in an embodiment, the real value P of the fuel rail pressure is transmitted to the ECU 450 by the fuel rail pressure sensor 400. The real value P of the fuel rail pressure is then fed-back and compared with the target value P*, in order to calculate the error P*−P. The error is then used as input of a proportional-integrative (PI) controller 510 that yields as output a feed-back contribution $Q^*_{PI}$.

The feedback contribution $Q^*_{PI}$ is then summed to a target value $Q^*_{inj}$ of a fuel output of the injector (i.e. a target value of the fuel flow rate (fuel quantity) requested by the at least one injector that is also indicative of the quantity/flow rate exiting from the fuel rail 170). The injector fuel output target value $Q^*_{inj}$ represents an estimation of the fuel flow-rate (fuel quantity) that exits the fuel rail 170 (due to the fuel injector 160 and the leakages) at a relevant rail pressure P*. The relationship between the injector fuel output target value $Q^*_{inj}$ (for example indicating a fuel quantity or fuel flow rate) and the relevant pressure P* (fuel injector characteristic) can be determined e.g. by means of experimental activities performed on a test bench and stored as a data item in the memory system connected to the ECU 450.

The sum of the feedback contribution $Q^*_{PI}$ and the injector fuel output target value $Q^*_{inj}$ results in a fuel pump output target value $Q^*_{HP}$ to be supplied to the fuel rail 170, i.e. a fuel pump flow rate (or a fuel pump quantity) to be supplied to the fuel rail 170. The fuel pump 180 is then driven in order to deliver the fuel pump output (fuel pump flow rate or fuel pump quantity) $Q^*_{HP}$ into the fuel rail 170.

The sensor based feedback control above described links the real pressure value P with the target pressure value P* according the following transfer function:

$$P = \left(\frac{1}{sC_{hyd}/K_p + 1}\right) \cdot P^*$$

wherein $K_p$ is the gain of the proportional part of the PI controller 510. For simplicity the gain $K_1$ of the integrative part of the PI controller 510 has been omitted.

In the case of failure of the rail pressure sensor 400, the fuel rail pressure cannot be measured and the sensor based feedback control cannot be carried out, thus the fuel rail pressure cannot be regulated. The detection of a pressure sensor failure condition can be carried out for example monitoring the output signal of the pressure sensor 400. A failure condition can be detected for example if the output signal remains constant for a determined period of time, for example if the signal remain to a zero logic or a one logic value.

Figure 4:
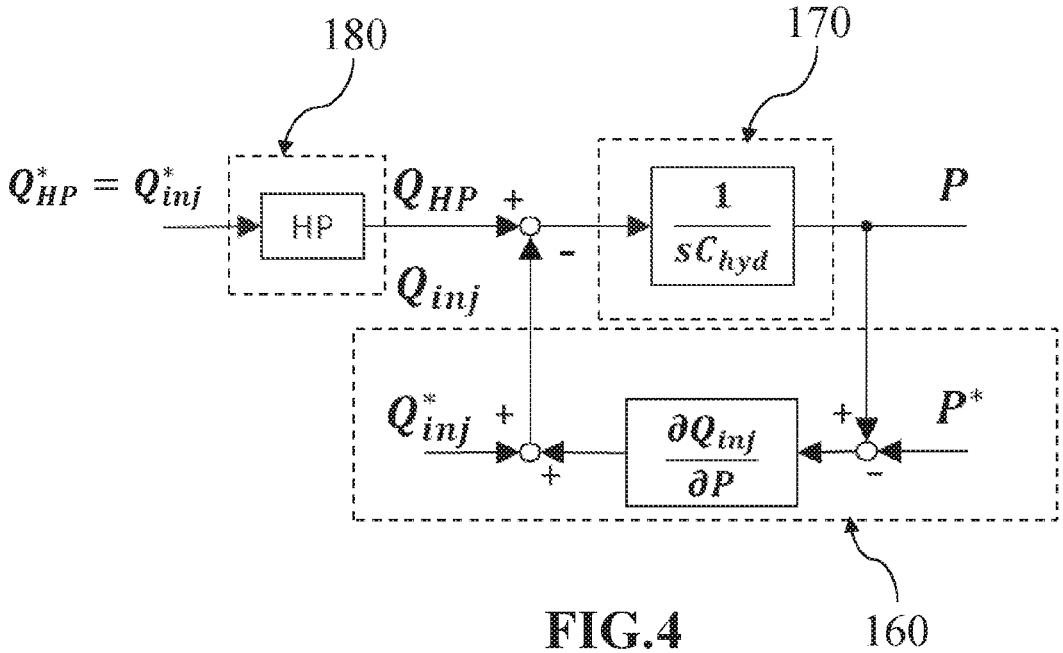
FIG. 4 is a block diagram of an embodiment of the method of controlling the fuel rail pressure according the present disclosure.
Figure 5:
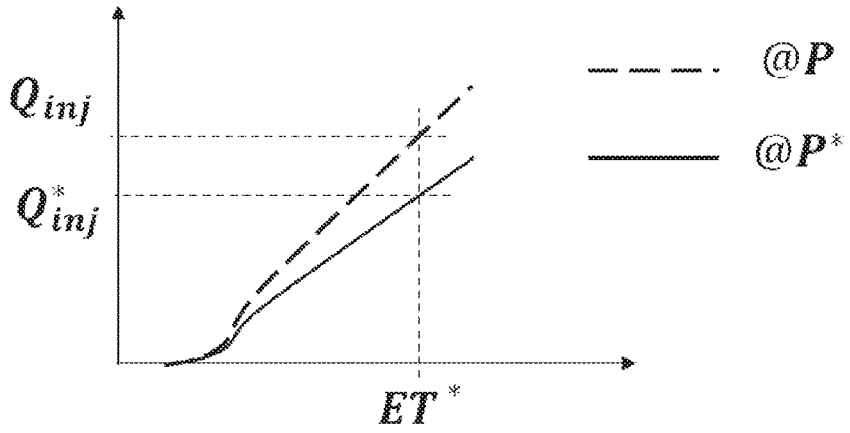
FIG. 5 is a characteristic curve of an injector.

With reference to FIG. 4, an embodiment of the method according to the present disclosure provides that, when a failure condition of the pressure sensor is detected, the fuel pump output target value $Q^*_{HP}$ is made equal to the injector fuel output target value $Q^*_{inj}$. In other words, the fuel pump flow rate (or fuel pump quantity) target value $Q_{HP}$* is made equal to the injector fuel flow rate (injector fuel quantity) target value $Q^*_{inj}$.

Moreover, the at least one fuel injector 160 is energized for an energizing time ET*. The energizing time ET* is determined as a function of the fuel rail pressure target value P* and of the injector fuel output target value $Q^*_{inj}$. In particular, the energizing time ET*, is the time required by the injector 160 to supply the injector fuel output target $Q^*_{inj}$, i.e. injector fuel flow rate or the injector fuel quantity, when the fuel rail pressure P is equal to the fuel rail pressure target value P*, according to the above mentioned fuel injector characteristic. In other words, when there is a failure condition of the fuel rail pressure sensor 400, $Q^*_{HP}$ is made equal to the injector fuel output target value $Q^*_{inj}$, and the injector 160 is energized for an energizing time ET*, independently from the real (actual) values of $Q_{inj}$ and P.

It has been found that the control system above disclosed is stable due in part to the monotonicity of the injector characteristics, so that the fuel rail pressure P will tend to reach the fuel rail pressure target value P*. In more detail, for a given energizing time, the fuel injector characteristic (shown in FIG. 5) may linearized as follows:

$$Q_{inj} = Q^*_{inj} + \frac{\partial Q_{inj}}{\partial P} \cdot (P - P^*)$$

Introducing this representation in the block diagram of FIG. 4, it should be appreciated that a fuel unbalancing between the fuel pump 180 and injector 160 will act to shift the pressure level to the value that guarantee the perfect balancing, that is the target pressure P*.

If the fuel pump output target value $Q^*_{HP}$ is made equal to the injector fuel output target value $Q^*_{inj}$, and the energizing time of the fuel injector is chosen as the energizing time target value ET* above mentioned, the pressure P within the fuel rail will tend to reach the fuel rail pressure target value P*.

In other words, by driving the fuel pump 180 in order to supply a target value $Q^*_{HP}$ of fuel flow rate (quantity) equal to the target value $Q^*_{inj}$ of the fuel flow rate (quantity) to be supplied by injector 160, and by energizing the injector 160 for a target value ET* of energizing time, the injector fuel output value $Q_{inj}$ (i.e. the fuel flow rate or fuel quantity injected by injector 160) will tend to reach the injector fuel output target value $Q^*_{inj}$, and the fuel rail pressure P will tend to reach the fuel rail pressure target value P*.

As an example, a value of the fuel rail pressure P greater than P* (as shown with dotted line in FIG. 5), will cause an injector fuel flow rate (injector fuel quantity) $Q_{inj}$ greater than $Q^*_{inj}$. The difference between the real output (fuel flow rate or fuel quantity) $Q_{HP}$ supplied by the fuel pump 180 (driven in order to provide a fuel pump output target value $Q^*_{HP}$ equal to the injector fuel output target value $Q^*_{inj}$) and the real flow rate (quantity) $Q_{inj}$ supplied by injector 160 (i.e. the fuel flow rate or quantity exiting from the fuel rail 170) will cause a reduction of the fuel rail pressure P towards the fuel rail pressure target value P*.

The actual fuel rail pressure P reaches the fuel rail pressure target value P* with a delay τ which depends on the injector characteristic and the fuel rail hydraulic capacitance:

$$\tau = \frac{\partial P}{\partial Q_{inj}} \cdot C_{hyd}$$

The present embodiment can guarantee the pressure regulation in the low-frequency range of the regulation bandwidth. Thus, when a fuel rail pressure sensor failure condition is detected, the fuel rail pressure control can be carried out without a fuel rail pressure measurement and the engine can work in a correct operating condition.

Figure 6:
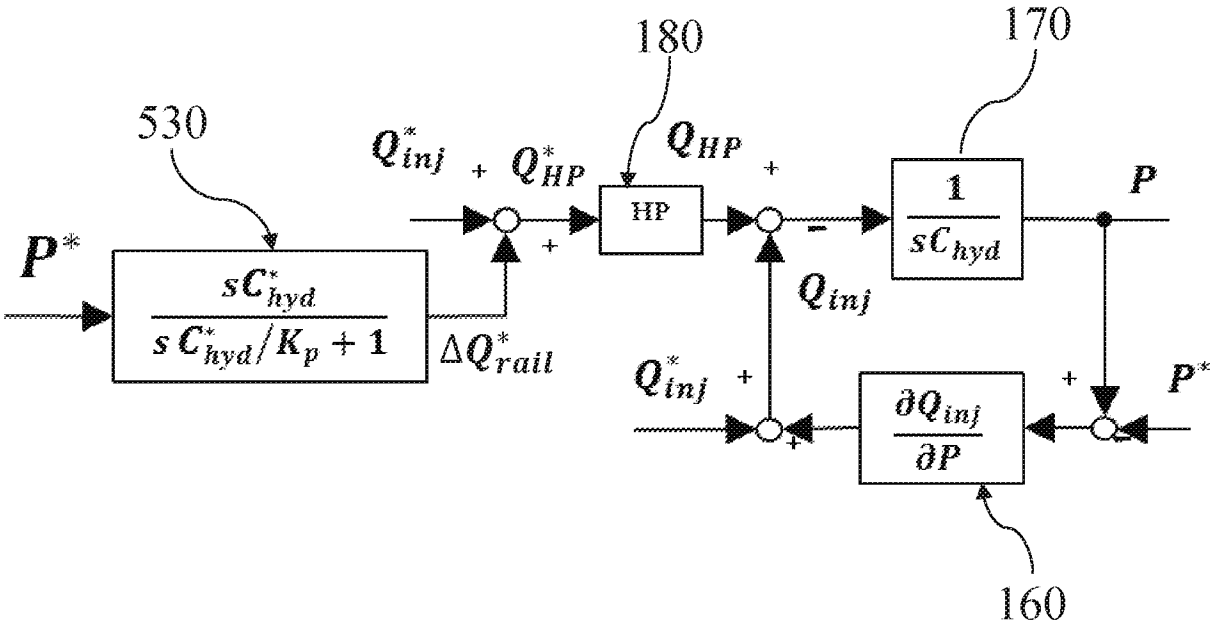
FIG. 6 is a block diagram of a further embodiment of the method of controlling the fuel rail pressure according the present disclosure.
Figure 7:
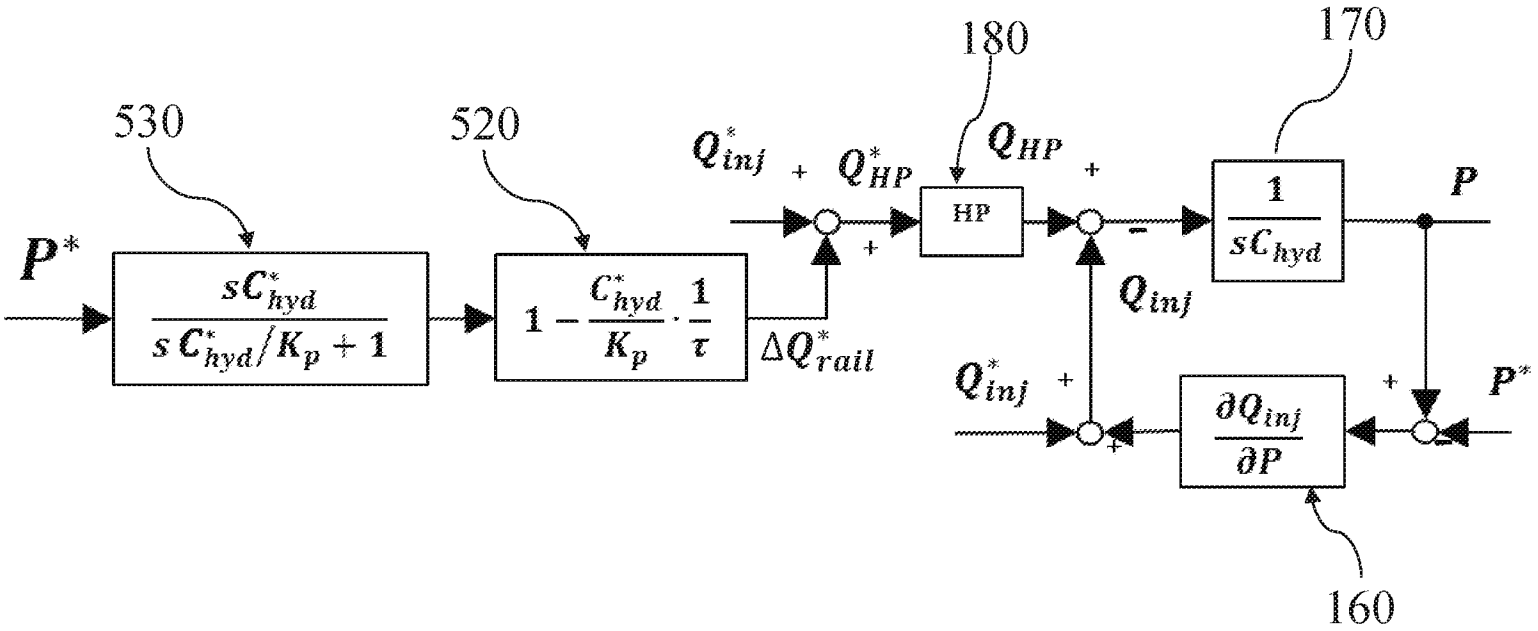
FIG. 7 is a block diagram of a further embodiment of the method of controlling the fuel rail pressure according the present disclosure.
Figure 8:
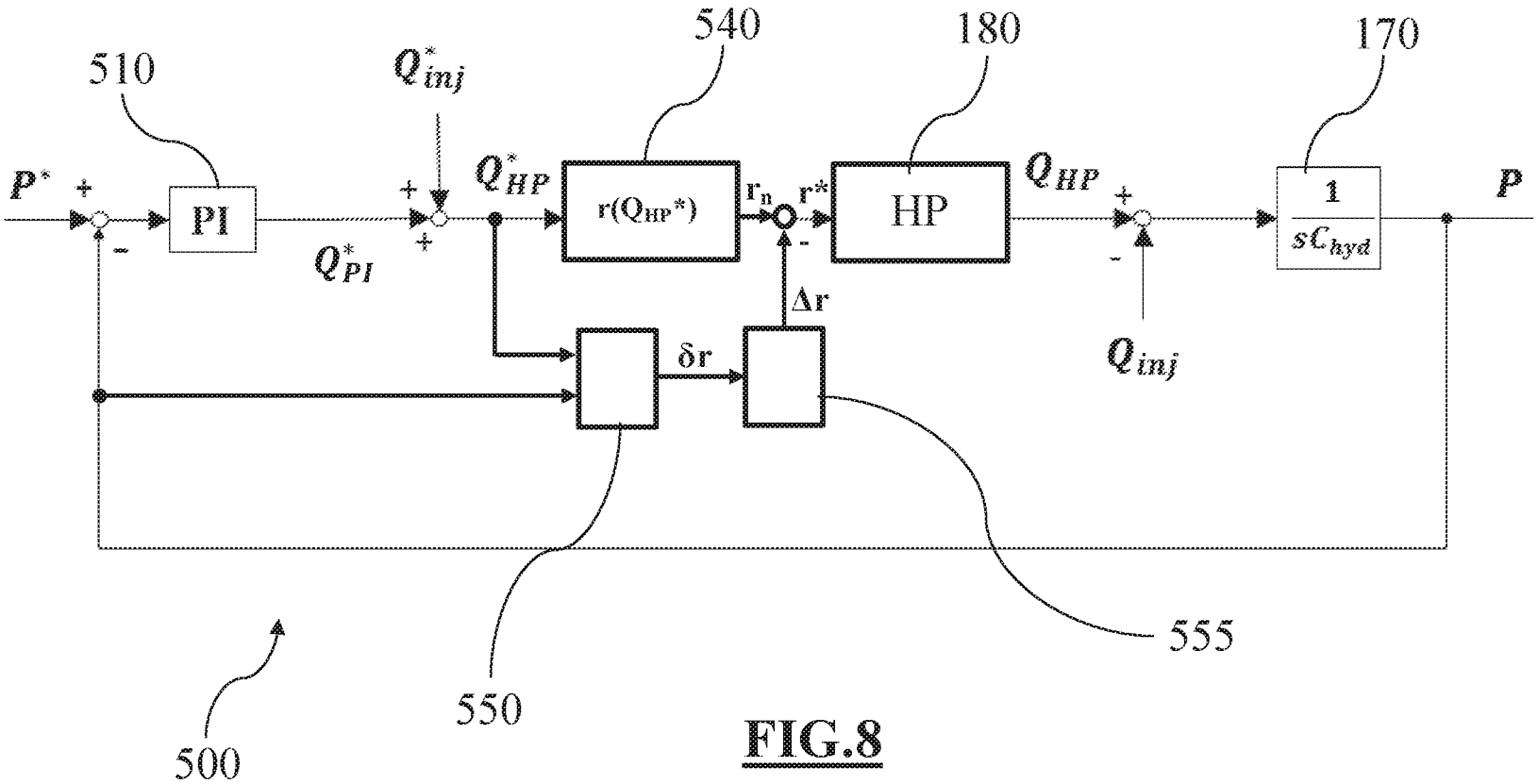
FIG. 8 is a block diagram of a further embodiment of the method of controlling the fuel rail pressure according the present disclosure during a normal state condition of the fuel rail pressure sensor.

In order to reduce the above mentioned delay, a further embodiment provides that, when a failure condition of the pressure sensor is detected, the fuel pump output target value $Q^*_{HP}$, i.e. the fuel flow rate (fuel quantity) to be supplied by the fuel pump 180 into the fuel rail 170 is equal to the sum of the injector fuel output target value $Q^*_{inj}$ and a compensation value $\Delta Q^*_{rail}$, as for example shown in FIG. 6.

The compensation value $\Delta Q^*_{rail}$ is determined as a function of the fuel rail pressure target value P*. The compensation value $\Delta Q^*_{rail}$ can be considered similar to the feedback contribution $Q^*_{PI}$ previously disclosed with reference to the sensor base feedback control shown in FIG. 3. This compensation value $\Delta Q^*_{rail}$ is determined emulating the Fuel Injection System 500 by means of a virtual model.

In an embodiment, the compensation value $\Delta Q^*_{rail}$ and the target value P* of the fuel rail pressure are linked by the following transfer function 530:

$$\Delta Q^*_{rail} = \frac{sC^*_{hyd}}{sC^*_{hyd}/K_p + 1} \cdot P^*$$

wherein $C^*_{hyd}$ is the hydraulic capacitance of the fuel rail of the virtual model and $K_p$ is the previously mentioned gain of the proportional part of the PI controller 510 of the system 500. The compensation value $\Delta Q^*_{rail}$ can be thus calculated into the ECU 450 as a function of the target value P* of the fuel rail pressure using the discrete-form of the Laplace inverse-transformation function, and then it can be subsequently added to the injector fuel output target value $Q^*_{inj}$ in order to determine the fuel pump output target value $Q^*_{HP}$.

This compensation value $\Delta Q^*_{rail}$ operates in the high-frequency range of the regulation bandwidth. Thus, the sum of the injector fuel output target value $Q^*_{inj}$ and the compensation value $\Delta Q^*_{rail}$ provides a sensor-less pressure control that guarantees the same bandwidth achievable with a rail pressure feedback control based on the data measured by a pressure sensor (as the one disclosed in FIG. 3). In other words, this embodiment allows to carry out a sensor-less rail pressure providing for a particularly quick response, that may be useful, for example, when the operating conditions of the internal combustion engine vary rapidly (e.g. during operation in urban traffic).

According to an embodiment, in order to get the dynamic behavior of a sensor-less control system as closer as possible to the sensor based feedback control, the compensation value $\Delta Q^*_{rail}$ is obtained applying a rescaling factor 520 to the transfer function 530. In an embodiment the rescaling factor 520 is equal to:

$$\left(1 - \frac{C^*_{hyd}}{K_p} \cdot \frac{1}{\tau}\right)$$

In an embodiment, the compensation value $\Delta Q^*_{rail}$ and the fuel rail pressure target value P* are linked by the following transfer function, which is obtained multiplying the previously disclosed transfer function 530 and rescaling factor 520:

$$\Delta Q^*_{rail} = \frac{sC^*_{hyd}}{sC^*_{hyd}/K_p + 1} \cdot \left(1 - \frac{C^*_{hyd}}{K_p} \cdot \frac{1}{\tau}\right) \cdot P^*$$

It has been proved that the rescaling factor improves the efficiency of the present embodiment.

The above discussed embodiments can guarantee a fuel rail pressure regulation with an accuracy which depends by the accuracy of the fuel pump 180. In other words, it has been assumed that when the fuel pump 180 is driven to supply (provide) the fuel pump output target value $Q^*_{HP}$, it actually supplies exactly the fuel pump target value $Q^*_{HP}$. However, when the fuel pump 180 is driven to supply the fuel pump output (flow rate or quantity) target value $Q^*_{HP}$, it is possible that the fuel pump 180 actually supplies a fuel pump output (flow rate or quantity) value $Q_{HP}$ which is different from the target value $Q^*_{HP}$.

Such a mismatch between the fuel pump flow rate (quantity) $Q_{HP}$ supplied by the fuel pump 180 and the fuel pump flow rate (quantity) target value $Q^*_{HP}$ will introduce a regulation error $\Delta P$ into the fuel rail pressure P depending on the injector characteristic:

$$\Delta P = \frac{\partial P}{\partial Q_{inj}} \cdot (Q_{HP} - Q^*_{HP})$$

In order to reduce the above mentioned regulation error $\Delta P$, a further embodiment provides for a step of compensating the mismatch between the fuel pump output value $Q_{HP}$, i.e. the fuel flow rate (quantity) actually supplied by the pump 180 and the fuel pump output target value $Q^*_{HP}$. In particular, as mentioned before, the fuel pump 180 may be driven by a driving signal r, for example the electric signal driving a fuel-metering valve usually associated to the fuel pump 180, to regulate the fuel pump output value $Q_{HP}$ which is supplied into the fuel rail 170. For simplicity, the fuel-metering valve and the fuel pump are shown as a single unit in FIG. 3 with the reference number 180.

The driving signal r can be determined, e.g. calculated, by the ECU using the fuel pump output (flow rate or quantity) target value $Q^*_{HP}$. In an embodiment, the ECU is provided with a correlation function 540 that yields as output a value of the driving signal r, as a function of a relevant value of the fuel pump output target value $Q^*_{HP}$. In other words, the correlation function 540 represents the theoretical relationship between the fuel pump output target value $Q^*_{HP}$ and the driving signal. Such a correlation function is generally provided, for example, by the supplier of the fuel metering valve.

As mentioned, the real behavior of the fuel pump 180 may be different for example due to production spreads, production tolerances and many other factors such as thermal drifts. As a consequence, for a given target value $Q^*_{HP}$, the nominal correlation function 540 generally yields a nominal value $r_n$ of the driving signal r which differs by an offset $\Delta r$ from the driving signal target value r* that really allows the fuel pump 180 to supply the fuel pump output (flow rate or quantity) target value $Q^*_{HP}$.

A control strategy for compensating the mismatch between the fuel pump output value $Q_{HP}$ and the fuel pump output target value $Q^*_{HP}$, using the feedback provided from a pressure sensor, is disclosed in US2015/0027411, which is incorporated herein by reference in its entirety. In general, US2015/0027411 teaches to calculate the difference between the fuel pump output target value $Q^*_{HP}$ (in particular of the fuel pump flow rate target value) and fuel pump output $Q_{HP}$, and in particular the fuel pump flow rate actually supplied by the fuel pump 180 (estimated from the value of the fuel rail pressure P measured by the fuel rail pressure sensor). Subsequently, a compensation error δr is calculated taking into account the derivative (slope) of the nominal correlation function. The compensation error δr represents e.g. an instantaneous addition amount of electrical current that should be supplied to the metering valve to compensate the above mentioned mismatch. The compensation error δr is subsequently used as input of an integrative regulator (including the integrator in the Laplacian form K/s) that yields as output a correction term Δr. As mentioned, Δr represents the value of the difference between the driving signal nominal value $r_n$ and the driving signal target value r*. The correction term Δr is then used to calculate the driving signal target value r* from the driving signal nominal value $r_n$. In this way a punctual compensation of the mismatch between the fuel pump output $Q_{HP}$ and the fuel pump output target value $Q^*_{HP}$ is achieved during a normal state of the fuel rail pressure sensor. Such a compensation cannot be carried out without the aid of a fuel rail pressure sensor 400.

In an embodiment of the method according to the present disclosure, the correction term Δr is thus estimated by means of a compensation function 560. In other words, a compensation function 560 is used to obtain a function based correction term $\Delta r_F$, that estimates the value of correction term Δr.

In an embodiment, the compensation function 560 depends on a plurality of operating parameters $P_1, P_2, \ldots, P_N$ of the fuel injection system of an internal combustion engine. In other words, the parameters $P_1, P_2, \ldots . P_N$ are the variables of the compensation function 560. Therefore, it is possible to obtain a function based correction term $\Delta r_F$ as a function of the above mentioned operative parameters $P_1, P_2, \ldots, P_N$, i.e. without the need of the fuel rail pressure sensor 400. As detailed later, these parameters may include the fuel pump output target value $Q^*_{HP}$, the rotational speed rpm of the fuel pump 180, the fuel rail pressure target value P*.

In an embodiment, the compensation function 560 is determined when the fuel rail pressure sensor 400 is still operative, in order to be used subsequently in case of failure of the fuel rail pressure sensor 400 itself. In particular, with reference to FIG. 8, it is shown an embodiment of the present disclosure wherein a driving signal nominal value $r_n$ is determined by means of the nominal correlation function 540 and a compensation error δr is determined in the same manner discussed above with reference to US2015/0027411 with the aid of the measure of the rail pressure sensor 400. This calculation is schematized by block 550.

In an embodiment, the compensation error δr is used as input of an integrative regulator 555 that yields as output a correction term Δr that may be used to calculate the driving signal target value r*, starting from the driving signal nominal value $r_n$. The integrative regulator 555 differs from the corresponding integrative regulator disclosed in US2015/0027411 by the fact that the integrative operation is carried out by using a plurality of weights calculated as a function of the operating condition of the fuel injection system.

In an embodiment, the integrative regulator 555 includes the operation of summing the products between an integrator with relevant coefficients $a_{11}$-$a_{22}$; $a_{111}$-$a_{222}$. Preferably, the coefficients $a_{11}$-$a_{22}$; $a_{111}$-$a_{222}$ are applied before and after the integrator. The integrator, in the Laplacian domain, is preferably in the form k/s. The coefficients $a_{11}$-$a_{22}$; $a_{111}$-$a_{222}$ are preferably function of the above mentioned operating parameters $P_1, P_2, \ldots, P_N$ of the compensation function 560.

Figure 9A:
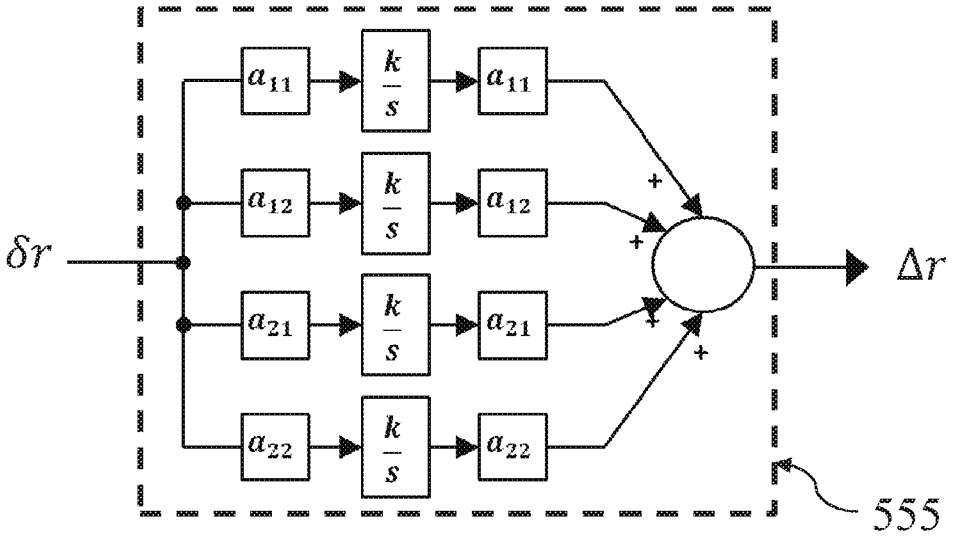
FIG. 9A is a block diagram of an embodiment of the integrative regulator of FIG. 8.

With reference to FIG. 9A, in a first embodiment the coefficients $a_{11}$, $a_{12}$, $a_{21}$, $a_{22}$ are calculated as a function of two parameters, i.e. the fuel pump output target value $Q^*_{HP}$ and the fuel pump rotational speed (indicated herein with reference rpm).

In an embodiment, by defining respectively $Q^*_{MAX}$ and $Q^*_{min}$ as the maximum and the minimum value of the fuel pump output target value $Q^*_{HP}$, and by defining respectively $rpm_{MAX}$ and $rpm_{min}$ as the maximum and the minimum value of the fuel pump rotational speed rpm, then coefficients $a_{11}$, $a_{12}$, $a_{21}$, $a_{22}$ can be calculated by means of the following formulas:

$$a_{11} = \frac{(Q^*_{MAX} - Q^*_{HP}) \cdot (rpm_{MAX} - rpm)}{(Q^*_{MAX} - Q^*_{min}) \cdot (rpm_{MAX} - rpm_{min})}$$

$$a_{12} = \frac{(Q^*_{MAX} - Q^*_{HP}) \cdot (rpm - rpm_{min})}{(Q^*_{MAX} - Q^*_{min}) \cdot (rpm_{MAX} - rpm_{min})}$$

$$a_{21} = \frac{(Q^*_{HP} - Q^*_{min}) \cdot (rpm_{MAX} - rpm)}{(Q^*_{MAX} - Q^*_{min}) \cdot (rpm_{MAX} - rpm_{min})}$$

$$a_{22} = \frac{(Q^*_{HP} - Q^*_{min}) \cdot (rpm - rpm_{min})}{(Q^*_{MAX} - Q^*_{min}) \cdot (rpm_{MAX} - rpm_{min})}$$

Figure 9B:
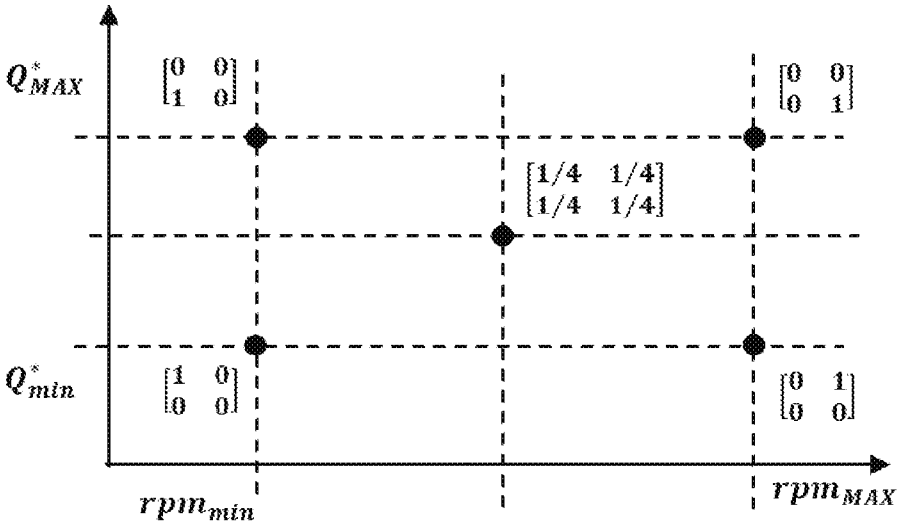
FIG. 9B is a graphic representation of the coefficients used by the integrative regulator shown in FIG. 9A.

FIG. 9B is a graphic representation of coefficients $a_{11}$, $a_{12}$, $a_{21}$, $a_{22}$, organized in a matrix 2×2 and calculated for some particular values of the target fuel output value $Q^*_{HP}$ and of the rotational speed value rpm. For example, when the fuel pump output target value $Q^*_{HP}$ is equal to $Q^*_{MAX}$ and the rotational speed value rpm is equal to $rpm_{min}$, coefficient $a_{21}$ is equal to 1 and the other coefficients $a_{11}$, $a_{12}$ and $a_{22}$ are equal to 0. When the fuel pump output target value $Q^*_{HP}$ and of the rotational speed value rpm assume a medium value between the correspondent maximum and the minimum values, coefficients $a_{11}$, $a_{12}$, $a_{21}$, $a_{22}$ are equal to each other to ¼ (see the central point of the graphical representation of FIG. 9B).

In a different embodiment, coefficients $a_{111}$, $a_{112}$, $a_{121}$, $a_{122}$, $a_{211}$, $a_{212}$, $a_{221}$, $a_{222}$ are calculated as a function of the three operating parameters: i.e. the fuel pump output target value $Q^*_{HP}$, the fuel pump rotational speed value rpm, and the fuel rail pressure target value P*. Analogously to the previous embodiment, by defining respectively $P_{MAX}$* and $P_{min}$* as the maximum and the minimum value of the fuel rail pressure target value P*, coefficients $a_{111}$, $a_{112}$, $a_{121}$, $a_{122}$, $a_{211}$, $a_{212}$, $a_{221}$, $a_{222}$ can be calculated by the following formulas:

$$a_{111} = \frac{(P^*_{MAX} - P^*) \cdot (Q^*_{MAX} - Q^*_{HP}) \cdot (rpm_{MAX} - rpm)}{(P^*_{MAX} - P^*_{min}) \cdot (Q^*_{MAX} - Q^*_{min}) \cdot (rpm_{MAX} - rpm_{min})}$$

$$a_{112} = \frac{(P^*_{MAX} - P^*) \cdot (Q^*_{MAX} - Q^*_{HP}) \cdot (rpm - rpm_{min})}{(P^*_{MAX} - P^*_{min}) \cdot (Q^*_{MAX} - Q^*_{min}) \cdot (rpm_{MAX} - rpm_{min})}$$

$$a_{121} = \frac{(P^*_{MAX} - P^*) \cdot (Q^*_{HP} - Q^*_{min}) \cdot (rpm_{MAX} - rpm)}{(P^*_{MAX} - P^*_{min}) \cdot (Q^*_{MAX} - Q^*_{min}) \cdot (rpm_{MAX} - rpm_{min})}$$

$$a_{122} = \frac{(P^*_{MAX} - P^*) \cdot (Q^*_{HP} - Q^*_{min}) \cdot (rpm - rpm_{min})}{(P^*_{MAX} - P^*_{min}) \cdot (Q^*_{MAX} - Q^*_{min}) \cdot (rpm_{MAX} - rpm_{min})}$$

$$a_{211} = \frac{(P^* - P^*_{min}) \cdot (Q^*_{MAX} - Q^*_{HP}) \cdot (rpm_{MAX} - rpm)}{(P^*_{MAX} - P^*_{min}) \cdot (Q^*_{MAX} - Q^*_{min}) \cdot (rpm_{MAX} - rpm_{min})}$$

$$a_{212} = \frac{(P^* - P^*_{min}) \cdot (Q^*_{MAX} - Q^*_{HP}) \cdot (rpm - rpm_{min})}{(P^*_{MAX} - P^*_{min}) \cdot (Q^*_{MAX} - Q^*_{min}) \cdot (rpm_{MAX} - rpm_{min})}$$

$$a_{221} = \frac{(P^* - P^*_{min}) \cdot (Q^*_{HP} - Q^*_{min}) \cdot (rpm_{MAX} - rpm)}{(P^*_{MAX} - P^*_{min}) \cdot (Q^*_{MAX} - Q^*_{min}) \cdot (rpm_{MAX} - rpm_{min})}$$

$$a_{222} = \frac{(P^* - P^*_{min}) \cdot (Q^*_{HP} - Q^*_{min}) \cdot (rpm - rpm_{min})}{(P^*_{MAX} - P^*_{min}) \cdot (Q^*_{MAX} - Q^*_{min}) \cdot (rpm_{MAX} - rpm_{min})}$$

Figure 11A:
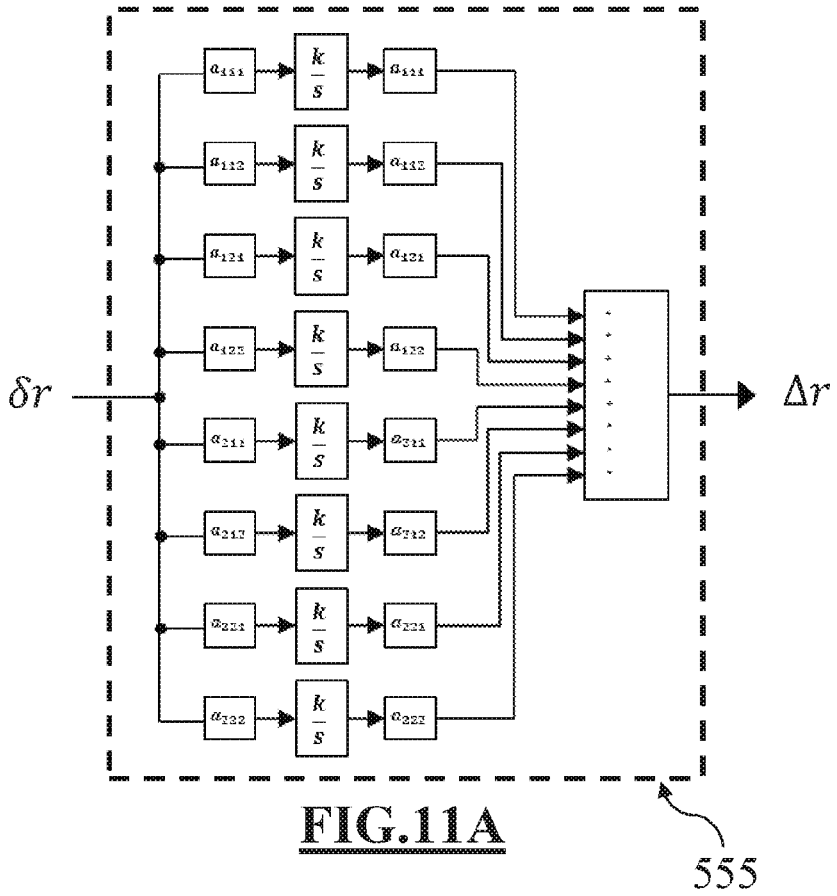
FIG. 11A is a block diagram of a further embodiment of the integrative regulator of FIG. 8.
Figure 11B:
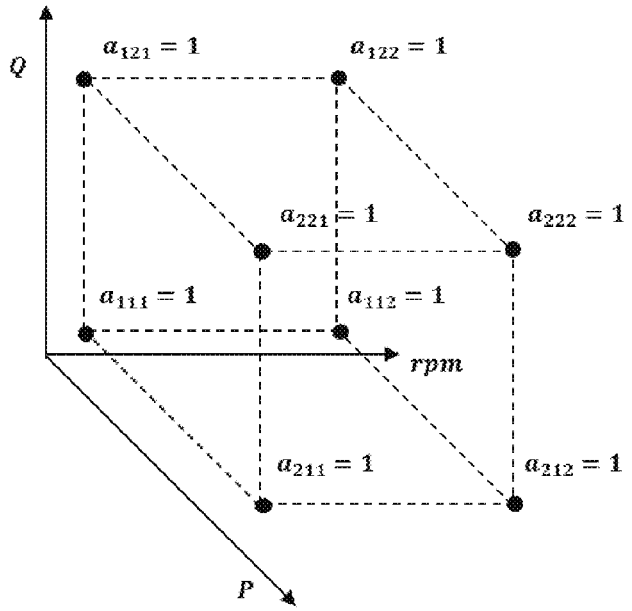
FIG. 11B is a graphic representation of the coefficients used by the integrative regulator shown in FIG. 11A.
Figure 12:
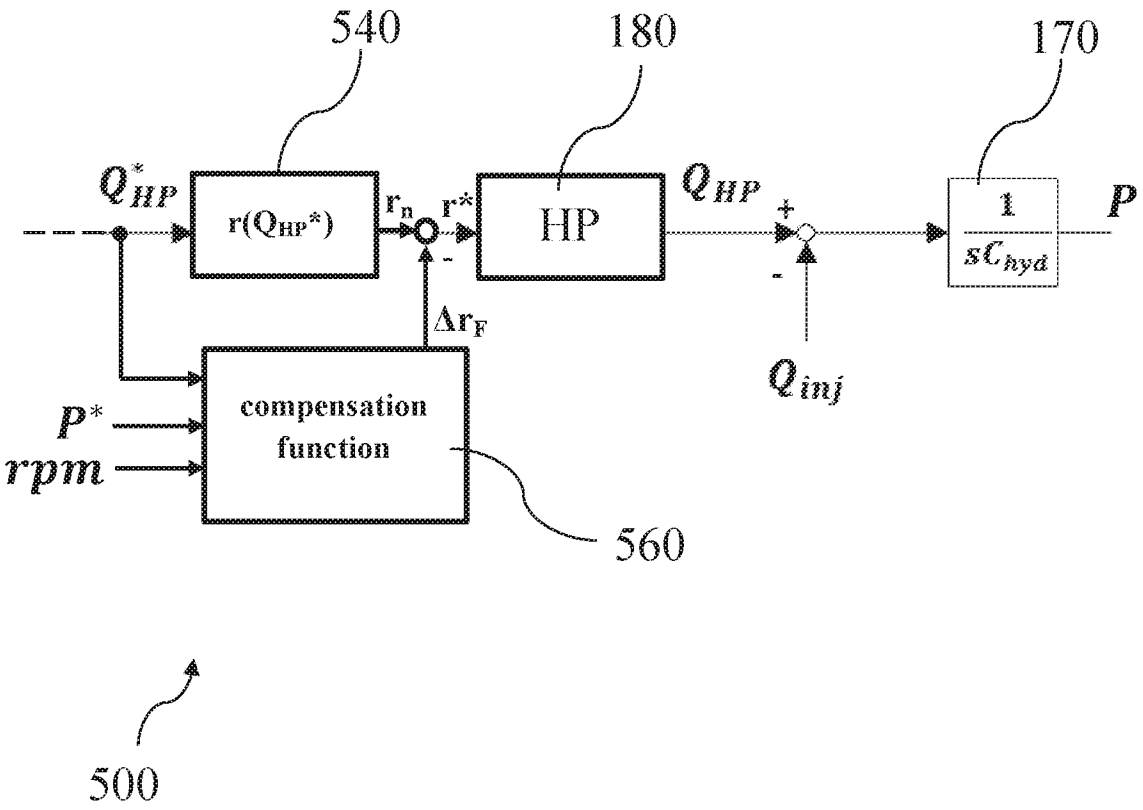
FIG. 12 is a block diagram of a further embodiment of the method of controlling the fuel rail pressure according the present disclosure.

In FIG. 1B it is shown a graphic representation of coefficients $a_{111}$, $a_{112}$, $a_{121}$, $a_{122}$, $a_{122}$, $a_{211}$, $a_{212}$, $a_{221}$, $a_{222}$, calculated for some particular values of the variables $Q^*_{HP}$, rpm and P*. Analogously to the graphic representation of FIG. 9B, FIG. 11B shows the values of coefficients $a_{111}$, $a_{112}$, $a_{121}$, $a_{122}$, $a_{211}$, $a_{212}$, $a_{221}$, $a_{222}$, calculated when the values of the operating parameters $Q^*_{HP}$, rpm and P* assume their relevant maximum and minimum values above defined. For a better visualization, the graphic representation of FIG. 11B shows only which coefficient $a_{111}$, $a_{111}$, $a_{112}$, $a_{121}$, $a_{122}$, $a_{211}$, $a_{212}$, $a_{221}$, $a_{222}$ is equal to 1, while the other coefficients are equal to 0.

In general, different operating parameters, or different combination of the operating parameters with respect to what shown, may be chosen. As a result, the number and the form of the coefficients $a_{11}$-$a_{22}$, $a_{111}$-$a_{222}$ will vary accordingly.

After determining the values of the coefficients $a_{11}$-$a_2$, $a_{111}$-$a_{222}$, each coefficient $a_{11}$-$a_{22}$, $a_{111}$-$a_{222}$ is multiplied by integrator k/s. All these products are then summed to obtain the integrative regulator 555. When the compensation error δr is inputted to the integrative regulator 555, the correction term Δr is obtained, i.e. the correction term Δr is the output of the integrative regulator 555. As previously mentioned, preferably the coefficients $a_{11}$-$a_{22}$, $a_{111}$-$a_{222}$ are multiplied before and after the integrator k/s.

According to an embodiment, once a plurality of values of Δr as a function of the relevant operating parameters $P_1$, $P_2$, . . . , $P_N$ are obtained, it is possible to determine a compensation function 560. The compensation function 560 can be determined, from the evaluation of the correction terms Δr obtained with the measure of the rail pressure sensor 400 as a function of the relevant operating parameters $P_1$, $P_2$, . . . $P_N$. In particular, as previously mentioned, the operating parameters $P_1$, $P_2$, . . . $P_N$ are used as variables for the compensation function 560. The compensation function 560 is determined (e.g. calculated) in order to approximate the trend of the values of the correction term Δr determined (e.g. calculated) during the normal state condition of the fuel rail pressure sensor as a function of the operating parameters $P_1$, $P_2$, . . . $P_N$.

As an example, with reference to the embodiment of FIGS. 9A, 9B, a compensation function 560 can be calculated from the evaluation of the values of the correction term Δr previously calculated as a function of the two parameters $Q^*_{HP}$ and rpm as previously discussed. The compensation function can be defined for example as a function of the type:

$$F(Q^*_{HP},\text{rpm})=\alpha_1\cdot Q^*_{HP}+a_2\cdot Q^*_{HP}\cdot\text{rpm}+\alpha_3\cdot\text{rpm}+\alpha_4$$

wherein $\alpha_1$, $\alpha_2$, $\alpha_3$ and $\alpha_4$ are the coefficients of the compensation function 560. As a result, the step of determining the compensation function 560 is carried out by determining the values of the coefficients $\alpha_1$, $\alpha_2$, $\alpha_3$, $\alpha_4$ of the compensation function 560. As mentioned, these values are calculated so that the compensation function approximate the trend of the values of correction term Δr previously calculated.

Other embodiments can provide for a compensation function 560 of different types.

As an example the compensation function 560 may depend on three parameters $P_1$, $P_2$, . . . $P_N$, e.g. the fuel pump output target value $Q^*_{HP}$, the fuel pump rotational speed rpm and the fuel rail pressure target value P*, as per the embodiment of FIGS. 11A, 11B.

In this case the compensation function can be defined for example as a function of the type:

$$F(Q^*_{HP},\text{rpm},P^*)=\beta_1\cdot P^*Q^*_{HP}\cdot\text{rpm}+\beta_2\cdot P^*\cdot Q^*_{HP}+\beta_3\cdot P^*\cdot\text{rpm}+\beta_4\cdot Q^*_{HP}\cdot\text{rpm}+\ldots\beta_5\cdot P^*+\beta_6\cdot Q^*_{HP}+\beta_7\cdot\text{rpm}+\beta_8$$

As before, $\beta_1$, . . . , $\beta_8$ are the coefficients of the compensation function 560.

In an embodiment, the compensation function 560 is then memorized, for example in the memory system 460. As an example, with reference to the previously disclosed embodiments, the compensation function coefficients $\alpha_1$-$\alpha_4$, $\beta_1$-$\beta_8$ may be stored in the memory system 460.

According to an embodiment, when a failure condition of the fuel rail pressure sensor 400 is detected, the correction term Δr cannot be calculated anymore due to the fact that it is no more possible to measure the fuel rail pressure P by means of the fuel rail pressure sensor 400. In this case it is possible to use the function based correction term $\Delta r_F$ in place of the correction term Δr. As mentioned, the function based correction term $\Delta r_F$ depends on operating parameters $P_1$, $P_2$, . . . $P_N$ that may be evaluated without the aid of the fuel rail pressure sensor 400. In other words, known the values of the operating parameters $P_1$, $P_2$, . . . $P_N$ on which the compensation function 560 depend, it is possible to obtain the value of the function based correction term $\Delta r_F$.

Figure 10:
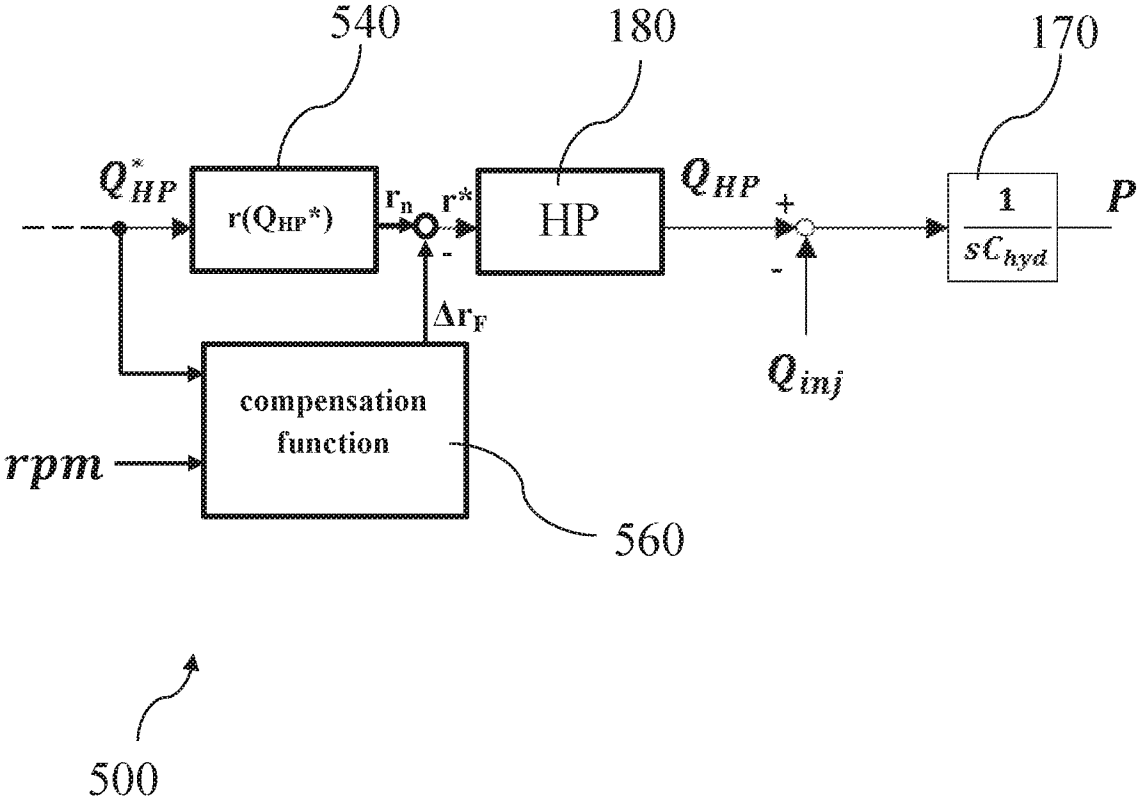
FIG. 10 is a block diagram of a further embodiment of the method of controlling the fuel rail pressure according the present disclosure.

As an example, with reference to FIG. 10, once are known the fuel pump output target value $Q^*_{HP}$ and the fuel pump rotational speed rpm, it is possible to obtain the value of the function based correction term $\Delta r_F$. In more detail, in an embodiment, while the fuel rail pressure sensor 400 is working, the value of correction term Δr is calculated by means of the fuel rail pressure sensor 400. Thanks to the integrative regulator 555, each calculated value of the correction term Δr is associated to relevant values of the operating parameters $P_1$, $P_2$, . . . $P_N$, in this case the fuel pump output target value $Q^*_{HP}$ and the fuel pump rotational speed rpm. As a result it is possible to establish a trend of the values of the correction term Δr as a function of the operating parameters $P_1$, $P_2$, . . . $P_N$. Subsequently, it is possible to determine a compensation function 560 that approximates the above mentioned trend of the values of the correction term Δr.

As an example, in this case it is possible to determine the coefficients $\alpha_1$-$\alpha_4$ of the compensation function:

$$F(Q^*_{HP},\text{rpm})=\alpha_1\cdot Q^*_{HP}+\alpha_2\cdot Q^*_{HP}\cdot\text{rpm}+\alpha_3\cdot\text{rpm}+\alpha_4$$

Subsequently, when needed (i.e. when the fuel rail pressure sensor 400 is not working) the compensation function 560 is used to calculate the value of the function based correction term $\Delta r_F$, as a function of the operating parameters $P_1$, $P_2$, . . . $P_N$. As an example, in this case, the current values of the fuel pump output target value $Q^*_{HP}$ and the fuel pump rotational speed rpm, are used as input of the compensation function 560. In other words, when the function coefficients $\alpha_1$-$\alpha_4$ and the values of $Q^*_{HP}$ and rpm are known, the output of the compensation function 560 is the value of the function based correction term $\Delta r_F$.

As mentioned, the above discussion is valid for any kind of compensation function 560. As an example the compensation function 560 of the embodiment of FIG. 11A, 11B, 12 may be used. In other words, it is possible e.g. to use a compensation function 560 in the form of:

$$F(Q^*_{HP},\text{rpm},P^*)=\beta_1\cdot P^*Q^*_{HP}\cdot\text{rpm}+\beta_2\cdot P^*\cdot Q^*_{HP}+\beta_3\cdot P^*\cdot\text{rpm}+\beta_4\cdot Q^*_{HP}\cdot\text{rpm}+\ldots\beta_5\cdot P^*+\beta_6\cdot Q^*_{HP}+\beta_7\cdot\text{rpm}+\beta_8$$

In this case, in order to obtain the needed value of the function based correction term $\Delta r_F$, there is the need to evaluate the compensation function coefficients $\beta_1$-$\beta_8$ (as per the above disclosure) and to use the current values of $Q^*_{HP}$, rpm and P* as input of the compensation function 560. In this way, a sensor-less control of the fuel rail pressure can be carried out with a compensation of the mismatch between the fuel pump output value $Q_{HP}$ and the fuel pump output target value $Q^*_{HP}$ carried out by means of the function based correction term $\Delta r_F$, without the need of the fuel rail pressure P.

In general, the accuracy of the correction term $\Delta r$ can be increased, by increasing the number N of operating parameter $P_1, P_2, \ldots, P_N$ associated to the calculation of the correction term $\Delta r$. However, increasing the number N of operating parameters, it will be more complex to determine the compensation function 560 that approximate the trend of the values of the correction term $\Delta r$.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method of controlling the fuel rail pressure of a fuel injection system of an internal combustion engine having a fuel rail, a fuel pump, a fuel rail pressure sensor and a fuel injector, the method comprising:

detecting a failure condition of said fuel rail pressure sensor;

determining a fuel rail pressure target value and an injector fuel output target value on the basis of an internal combustion engine operating condition;

determining a fuel pump output target value to be supplied into the fuel rail;

driving the fuel pump in order to provide the fuel pump output target value;

wherein the fuel pump output target value is equal to the sum of the injector fuel output target value and a compensation value determined as a function of the fuel rail pressure target value;

wherein said compensation value is determined by means of a transfer function in the form of:

$$\Delta Q^*_{rail} = \frac{sC^*_{hyd}}{sC^*_{hyd}/K_p + 1} P^*$$

wherein $C^*_{hyd}$ is an equivalent hydraulic capacitance of the fuel volume stored inside the fuel rail and any pipes connected thereto and $K_p$ is a proportional gain; and wherein the fuel injector is energized for an energizing time target value determined on the basis of said fuel rail pressure target value and said injector fuel output target value.

2. The method according to claim 1 wherein, said compensation value is rescaled multiplying said transfer function by a rescaling factor.

3. The method according to claim 2 wherein said rescaling factor is equal to:

$$\left(1 - \frac{C^*_{hyd}}{K_p} \cdot \frac{1}{\tau}\right)$$

wherein $\tau$ is a delay according to which the fuel rail pressure reaches the fuel rail pressure target value when the fuel pump output target value is made equal to the injector fuel output target value.

4. The method according to claim 3 wherein, $\tau$ depends on the injector characteristic and on the fuel rail hydraulic capacitance ($C_{hyd}$), according to the relationship:

$$\tau = \frac{\partial P}{\partial Q_{inj}} \cdot C_{hyd}.$$

5. The method according to claim 1, wherein said energizing time target value is a function of the fuel rail pressure target value and of the injector fuel output target value according to a fuel injector characteristic.

6. The method according to claim 1, further comprising driving the fuel pump with a driving signal determined from a nominal driving signal which is a function of the fuel pump output target value and a function based correction term determined by a compensation function.

7. The method according to claim 6, wherein said compensation function depends on a plurality of operating parameters of the fuel injection system of an internal combustion engine.

8. The method according to claim 7, further comprising:

determining a compensation error as a function of the fuel rail pressure value measured by the fuel pressure sensor;

determining a plurality of coefficients as a function of said plurality of operating parameters;

determining a correction term from said compensation error with an integrative regulator;

obtaining different values of said correction term as a function of different values of said operating parameters by repeatedly determining the compensation error, the plurality of coefficients and the correction term; and determining the compensation function as a function of said different values of said correction term;

wherein said integrative regulator comprises the operation of summing the products between an integrator with each of said coefficients and wherein the preceding steps are carried out before detecting a failure condition of said fuel rail pressure sensor.

9. The method according to claim 7, wherein said compensation function is determined before detecting a failure condition of said fuel rail pressure sensor.

10. The method according to claim 9, further comprising:

determining a compensation error as a function of the fuel rail pressure value measured by the fuel pressure sensor;

determining a plurality of coefficients as a function of said plurality of operating parameters;

determining a correction term from said compensation error with an integrative regulator;

obtaining different values of said correction term as a function of different values of said operating parameters by repeatedly determining the compensation error, the plurality of coefficients and the correction term; and determining the compensation function as a function of said different values of said correction term;

wherein said integrative regulator comprises the operation of summing the products between an integrator with each of said coefficients and wherein the preceding steps are carried out before detecting a failure condition of said fuel rail pressure sensor.

11. The method according to claim 7, further comprising storing said compensation function in memory.

12. The method according to claim 7, wherein said plurality of operating parameters comprise the fuel pump output target value to be supplied by the fuel pump into the fuel rail and the fuel pump rotational speed.

13. The method according to claim 7, wherein said plurality of operating parameters further comprise the fuel rail pressure target value.

* * * * *